US005365848A

United States Patent [19]

Löhrke

[11] Patent Number: 5,365,848

[45] Date of Patent: Nov. 22, 1994

[54] CLAMPING DEVICE WITH PARALLEL CLAMPING SURFACES

[75] Inventor: Manfred Löhrke, Leimen, Germany

[73] Assignee: Heidelberger Druckmaschinen AG, Heidelberg, Germany

[21] Appl. No.: 177,434

[22] Filed: Jan. 5, 1994

[30] Foreign Application Priority Data

Jan. 5, 1993 [DE] Germany ..... 4300099

[51] Int. Cl.[5] ..... B41F 1/36

[52] U.S. Cl. ..... 101/415.1; 101/378; 101/409

[58] Field of Search ..... 101/415.1, 378, 409, 101/410, 411, 412, 475

[56] References Cited

U.S. PATENT DOCUMENTS

| | | | |
|---|---|---|---|
| 3,408,933 | 11/1968 | Henmach et al. | 101/415.1 |
| 4,133,264 | 1/1979 | Fermi et al. | 101/415.1 |
| 4,191,106 | 3/1980 | Fermi et al. | 101/415.1 |
| 4,223,604 | 9/1980 | Brehm et al. | 101/415.1 |
| 5,094,165 | 3/1992 | Sugiyama et al. | 101/415.1 |
| 5,107,763 | 4/1992 | Gens | 101/415.1 |
| 5,181,469 | 1/1993 | Merkel et al. | 101/415.1 |
| 5,184,554 | 2/1993 | Merkel et al. | 101/415.1 |
| 5,213,038 | 5/1993 | Takahashi et al. | 101/410 |

FOREIGN PATENT DOCUMENTS

| | | |
|---|---|---|
| 0411731 | 2/1991 | European Pat. Off. . |
| 4128994 | 7/1992 | Germany . |
| 1513018 | 6/1978 | United Kingdom . |
| 2206534 | 1/1989 | United Kingdom . |

*Primary Examiner*—Edgar S. Burr
*Assistant Examiner*—Lynn D. Hendrickson
*Attorney, Agent, or Firm*—Herbert L. Lerner; Laurence A. Greenberg

[57] ABSTRACT

Clamping device for locking a printing plate on a cylinder of a printing press includes two parallel clamping bars formed with respective clamping surfaces, at least one of the clamping bars being movable perpendicularly to the clamping surfaces, and an element for producing a clamping force between the clamping bars, a first one of the clamping bars including at least one leaf spring formed with the clamping surface of the first clamping bar, the clamping surface thereof being cooperatively clampable with the clamping surface of the second one of the clamping bars, the first clamping bar further including a member formed with at least one concave segment-shaped recess, the leaf spring being formed with a corresponding convex segment-shaped protrusion supported in the recess.

8 Claims, 4 Drawing Sheets

CLAMPING DEVICE WITH PARALLEL CLAMPING SURFACES

SPECIFICATION

The invention relates to a clamping device for locking a printing plate on the cylinder of a printing press, the clamping device having two parallel clamping bars formed with respective clamping surfaces, at least one of the clamping bars being movable perpendicularly to the clamping surfaces, and an element for producing a clamping force between the two clamping bars.

Such a clamping device has become known heretofore from published German Patent Document DE 41 28 994 A1. This clamping device has two parallel clamping bars formed with respective radially extending clamping surfaces. The conventionally provide rear or trailing bent-away end of a printing plate is initially clamped between the clamping bars and, thereafter, the clamping plate is tensioned or tautened by a movement of both clamping bars in a circumferential direction.

A further clamping device of the type initially mentioned in the introduction hereto has become known from published German Patent Document DE 41 29 831 A 1. This publication relates to a clamping device for the front or leading end of the printing plate, the clamping device having a fixed upper clamping bar and a movable lower clamping bar, both of the clamping bars being formed with respective clamping surfaces extending in a direction substantially tangential to a cylinder housing.

These two clamping devices are cited only by way of example, inasmuch as the prior art includes countless possible constructions. The heretofore known clamping devices have been subject to the problem that it is extremely difficult to produce parallel clamping surfaces within a narrow tolerance range. This is attributable to the fact that, particularly in the case of printing presses for large paper sizes or formats, the clamping surfaces expand to a considerable extent, so that the surfaces often have to undergo special treatment or processing. The surfaces are thus frequently hardened, for example, and, in some cases, provided with a holding profile. It has also become known to coat them with suitable materials, such as urethane or tungsten-cobalt carbide, for example. The surfaces are also required to have a given peak-to-valley height, because this is of advantage with regard to the clamping force. If it is intended, after hardening or surface-coating, to regrind the surface, however, in order to provide the surfaces with a parallelism within a narrow tolerance range, then the given peak-to-valley height will usually become lost again and, respectively, in the case of coating, the coating layer would be removed again at various locations and, also, the surface characteristics of the coating would again be lost. For this reason, it is not practical to rework the surface after hardening or coating. Workpieces in which the surfaces have warped due to hardening or surface-coating must then be rejected as scrap, which renders the already expensive manufacturing process considerably more expensive.

It is accordingly an object of the invention to provide a clamping device with clamping parallel surfaces which can be manufactured economically and which, in the clamped state, exhibits clamping surfaces which are parallel within a narrow tolerance range.

With the foregoing and other objects in view, there is provided, in accordance with the invention, a clamping device for locking a printing plate on a cylinder of a printing press, the clamping device comprising two parallel clamping bars formed with respective clamping surfaces, at least one of the clamping bars being movable perpendicularly to the clamping surfaces, and an element for producing a clamping force between the clamping bars, a first one of the clamping bars comprising at least one leaf spring formed with the clamping surface of the first clamping bar, the clamping surface thereof being cooperatively clampable with the clamping surface of the second one of the clamping pars, the first clamping bar further comprising means formed with at least one concave segment-shaped recess, the leaf spring being formed with a corresponding convex segment-shaped protrusion supported in the recess.

An advantage of the invention is that the clamping surface on the leaf spring is adjusted to the other clamping surface, and parallelism is established therebetween. It is thereby possible, also in the case of a less narrow manufacturing tolerance, to attain a parallelism of the clamping surfaces. The alignment of the leaf-spring clamping surface and the parallelism attained thereby result in high clamping forces.

In accordance with another feature of the invention, the clamping bars, respectively, are formed of three sections, and include a plurality of leaf springs including the one leaf spring, at least one of the plurality of leaf springs being supported on respective outer ones of the sections of the first clamping bar.

An advantage of this construction is that the shorter leaf springs are easier to align, thus considerably increasing the operational reliability. With regard to the sections, each section is likewise aligned within the tolerance of its mounting support so that, overall, there is optimal alignment of the various individual surfaces.

In accordance with a further feature of the invention, the clamping bars, respectively, are formed of three sections, and including a plurality of leaf springs including the one leaf spring, at least one of the plurality of leaf springs being supported on respective outer ones of the sections of the first clamping bar.

There are many clamping devices which exhibit from the outset such a three-way division, wherein the outer sections are displaceable in axial direction, which serves to expand or spread the printing plate. Such spreading or expansion of the printing plate is necessary for register correction in the case of printing stock which stretches. It is precisely with such clamping devices that the construction according to the invention is of advantage, because a spreading or expansion of the printing plate by the outward displacement of the outer sections calls for high clamping forces so that the printing plate is not pulled out of the sections which are to be displaced. In order to attain particularly high clamping forces and good alignment, in accordance with an added feature of the invention, two leaf springs are supported on the sections.

In accordance with an additional feature of the invention, the leaf spring is formed with parts projecting beyond the convex protrusion thereof, the parts forming a hollow with respect to the first clamping bar, the hollow providing space for a horizontal alignment.

An advantage of this construction is that the convex protrusion and the concave recess, which, respectively, have and are defined by surfaces which are to slide on one another, can be manufactured with reduced surface area. This increases slidability and therefore the ease of movement and operational reliability of the alignment of the clamping surfaces.

In accordance with yet another feature of the invention, the clamping surface formed on the leaf spring of the first clamping bar is a concave clamping surface having respective ends which are nearer to the clamping surface of the second clamping bar than is a central region of the concave clamping surface, the leaf spring having an elasticity which, in a clamped condition of the first and second clamping bars, permits the clamping surfaces to lie on top of one another. This construction attains even higher clamping forces. In the case of a leaf spring without a hollow, the concave construction of the clamping surface may only be very minimal, in order yet to ensure that the clamping surfaces lie on top of one another due to the springing-back of the leaf spring.

This construction further ensures a uniform surface pressure across the entire width of the leaf spring, it being possible simultaneously to lower further the requirements with regard to the precision or accuracy of manufacture. Improved operation together with a simultaneous reduction in manufacturing costs therefore occurs.

In accordance with yet a a further feature of the invention the central region of the concave clamping surface is formed with a recess. The reason for providing such a recess is that the leaf springs are able to be aligned in a manner similar to a balance or scales. This construction enhances the alignability of the leaf springs.

In accordance with a concomitant feature of the invention, a central region of the leaf spring is formed with a hole, and a spring pin is received with play in the hole formed in the leaf spring and is connected to the first clamping bar, the play providing a clearance of such dimension as to assure a horizontal alignment of the leaf spring. A purpose for this construction embodiment is to hold the leaf spring tightly to prevent it from being lost.

Other features which are considered as characteristic for the invention are set forth in the appended claims.

Although the invention is illustrated and described herein as embodied in a clamping device with parallel clamping surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 5 is an enlarged fragmentary cross-sectional view of

Figure 4:
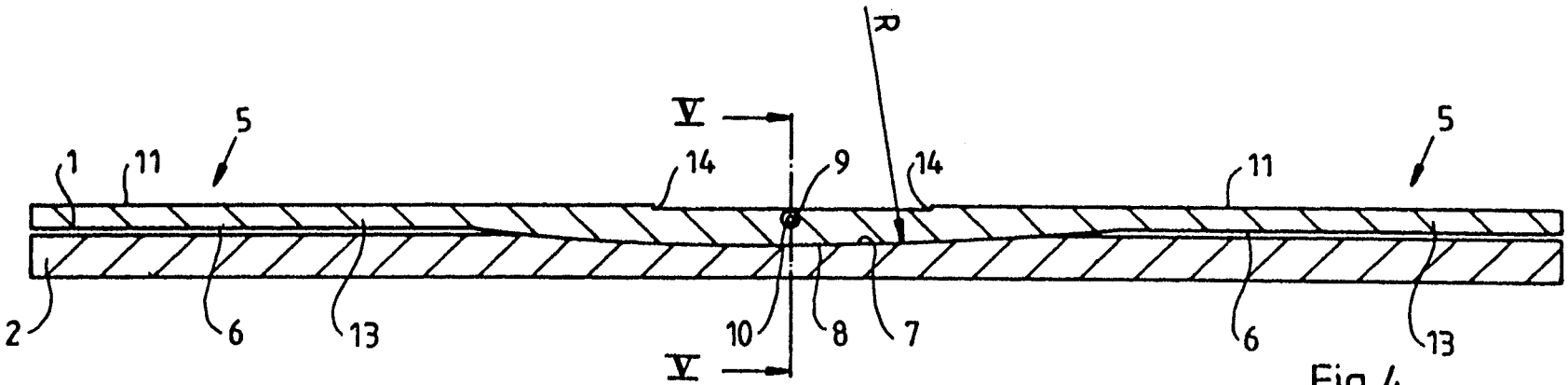
FIG. 4 is a cross-sectional view of a leaf spring mounted on a clamping bar.
Figure 6:
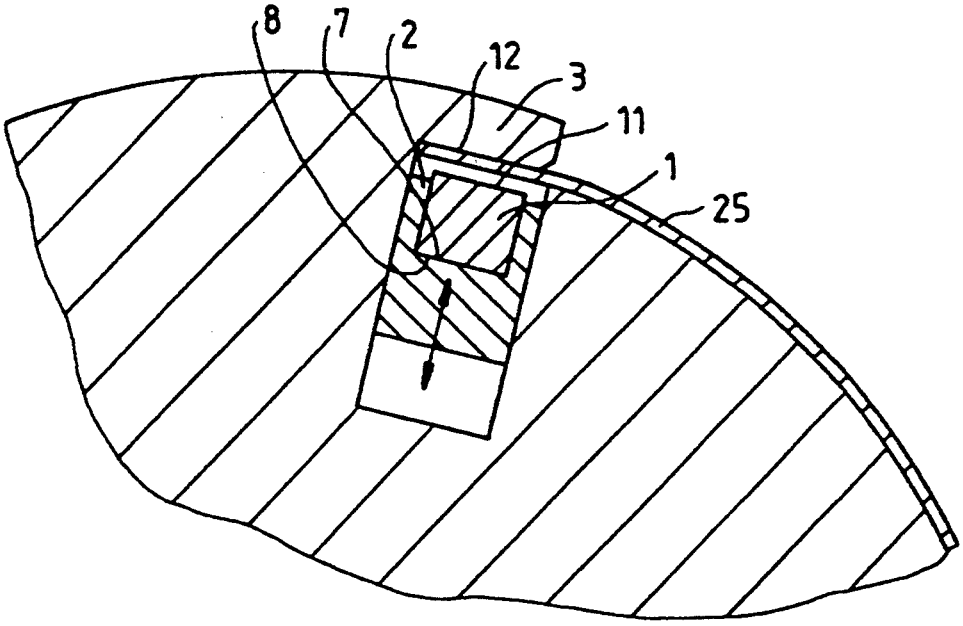
Figure 7:
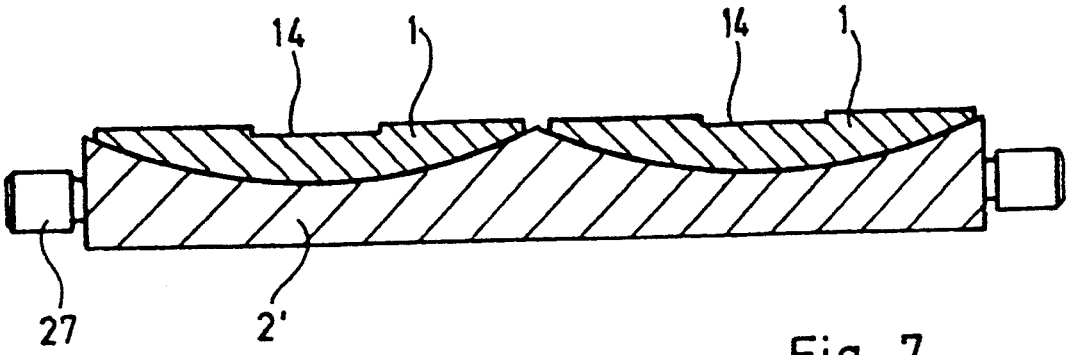

FIG. 4 taken in the direction of the arrows;

FIG. 6 is a fragmentary cross-sectional view of a plate cylinder whereon a front or leading edge of a printing plate is clamped by a clamping device according to the invention;

FIG. 7 is a sectional view of a first clamping bar having two leaf springs; and

Figure 8:
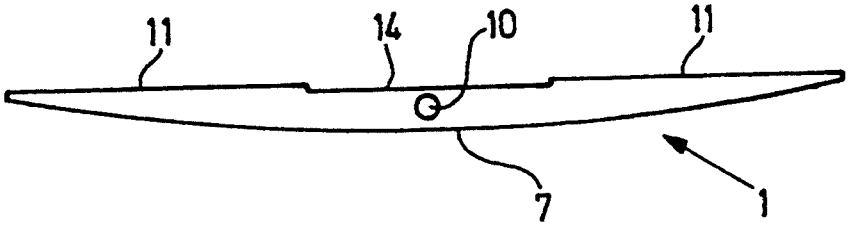

FIG. 8 is an elevational view of a leaf spring for particularly high forces.

Figure 1:
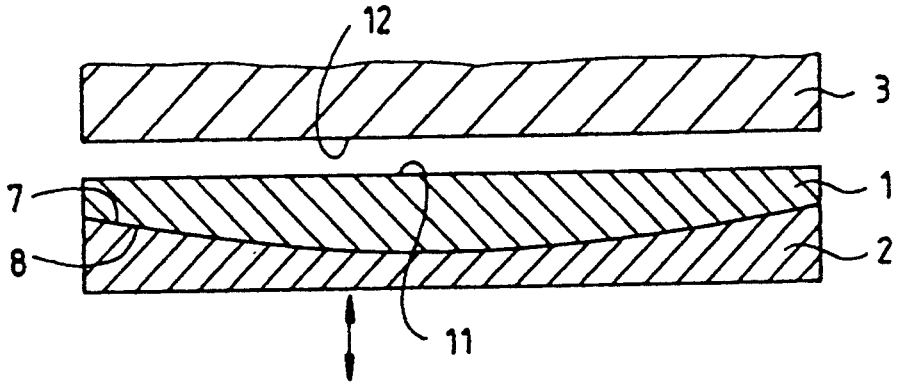
FIG. 1 is a fragmentary sectional view of a simplified embodiment of the invention which illustrates the operating principle which is involved therein.

Referring now to the drawings and, first, particularly to FIG. 1 thereof, there is shown therein a relatively simple embodiment which illustrates the basic principle of the invention. A clamping device for clamping a printing plate so as to lock the latter on a cylinder of a sheet-fed printing press includes a first clamping bar 2 which, in this embodiment, is in the form of a movable clamping bar, and a second clamping bar 3, which cooperates with the latter clamping bar 2. Both the first clamping bar 2 and the second clamping bar 3 are formed with respective clamping surfaces 11 and 12, which are movable relatively towards one another for holding the printing plate with a required contact force. In order to attain high holding forces, the clamping surfaces 11 and 12 must be aligned exactly parallel to one another. This parallel alignment is achieved by means of a leaf spring 1 which is mounted on the first clamping bar 2. The leaf spring 1 is mounted thereon by means of a concave segment-shaped recess 8 formed in the first clamping bar 2. The leaf spring 1 has a convex segment-shaped projection 7 corresponding to the concave segment-shaped recess 8 formed in the first clamping bar 2. The surfaces of the convex projection 7 and of the concave recess 8 are formed so that the leaf spring 1 is able to slide on the first clamping bar 2, as a result of which, after the clamping device has been closed, the clamping surface 11 of the leaf spring 1 is aligned parallel to the clamping surface 12 of the second clamping bar 3. This simple embodiment may also be constructed so that a plurality of leaf springs may be mounted adjacent one another.

Figure 2:
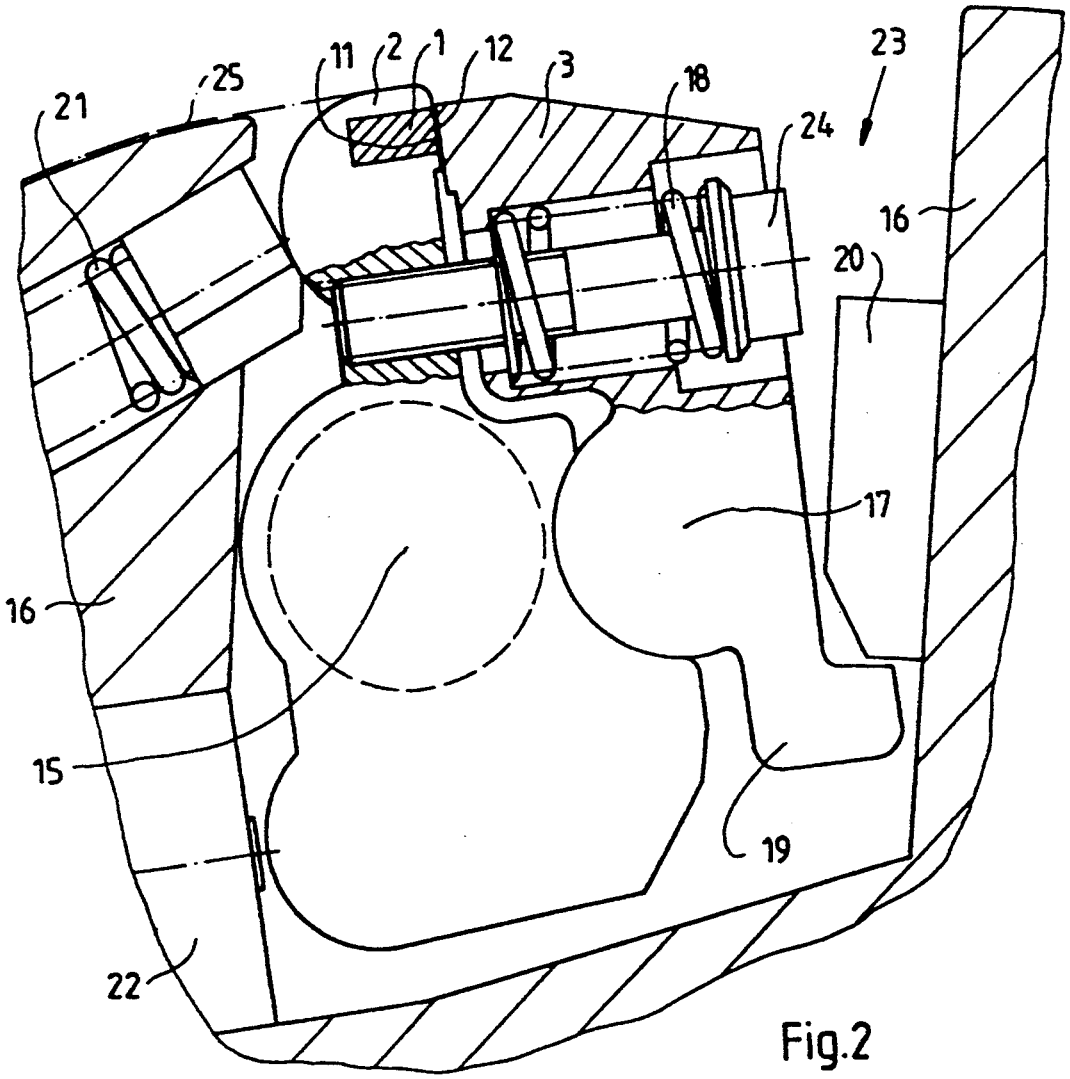
FIG. 2 is a fragmentary cross-sectional view of an otherwise state-of-the-art clamping and tensioning device incorporating the improvement according to the invention of the instant application.

FIG. 2 shows a clamping and tensioning device of the type heretofore known from the hereinaforementioned published German Patent Document DE 41 28 994 A1. This clamping and tensioning device has been further improved in accordance with the invention. A cylinder 16 is provided with a cylinder gap 23 wherein the clamping and tensioning device is disposed. The first clamping bar 2 is held in the cylinder 16 by means of a rotatable mounting support 15 and is formed at a front end thereof with a clamping surface 11 which cooperates with a clamping surface 12 formed on the second clamping bar 3. The second clamping bar 3 likewise has a rotatable mounting support 17, which is provided on the first clamping bar 2. Both the first clamping bar 2 and the second clamping bar 3 are each furnished with a lever directed into the interior of the cylinder 16, with reference to the respective rotatable mounting supports 15 and 17. The inwardly-directed lever of the first clamping bar 2 cooperates with at least one adjusting element 22, which serves for swivelling the clamping and tensioning device. In this regard, the adjusting element 22 swivels the first clamping bar 2 in a direction opposite to the tensioning direction for the printing plate 25, thereby relaxing the tension therein. For the purpose of applying tension to the printing plate 25, tensioning springs 21 are provided, which are disposed in the front region of the first clamping bar 2. Clamping is accomplished by means of clamping springs 18, which are disposed in the front region of the second clamping bar 3 and are situated between the second clamping bar 3 and the heads of clamping-spring bolts 24 which penetrate the second clamping bar 3 and are screwed into the first clamping bar 2. The clamping force is nullified or cancelled by a holding element 19, which cooperates with a fixed stop 20.

The operating principle is as follows:

Due to the actuation of one or more adjusting elements 22, the first clamping bar 2 swivels against the spring force of the tensioning springs 21, the holding element 19, in the course of the swivelling motion, engaging with the fixed stop 20 and, overcoming the force of the clamping springs 18, opening the tensioning device.

The bent-away end of a printing plate 25 is inserted between the clamping surfaces 11 and 12, and the adjusting element 22 is then drawn back, with the result that the tensioning springs 21 cause a swivelling motion in the plate-tensioning direction. In this regard, the holding element 19 distances itself from the fixed stop 20 and, as a result thereof, the clamping springs 18 press the clamping bar 3 against the first clamping bar 2, clamping the end of the printing plate 25. After the printing plate 25 has been clamped, it is subjected to tension with the aid of the tensioning springs 21 by a further return-motion of the adjusting element 22.

Figure 3:
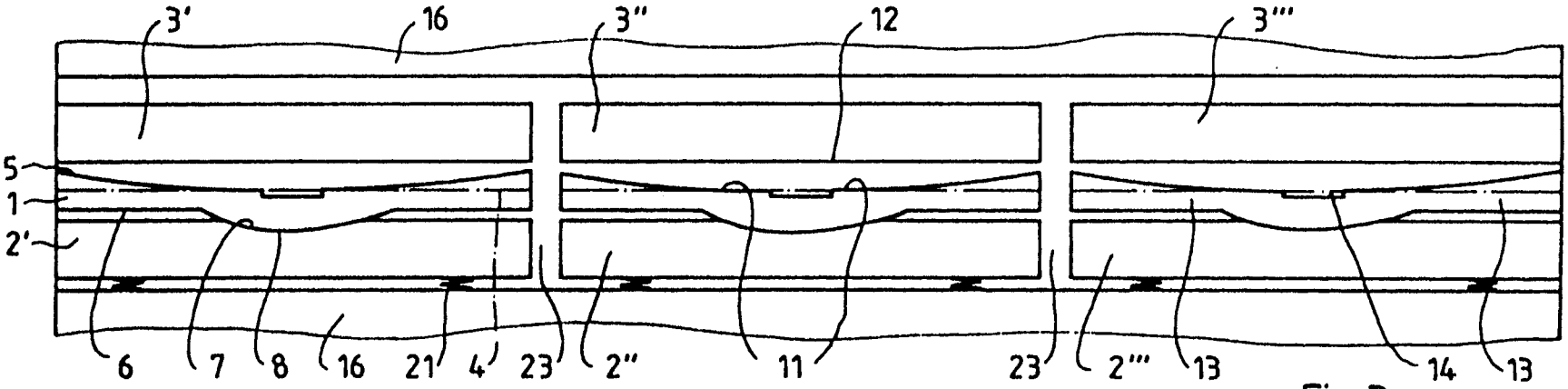
FIG. 3 is a fragmentary diagrammatic elevational view of a three-part clamping and tensioning device constructed in accordance with the invention.

The construction of the clamping and tensioning device according to the invention provides for the clamping bar 2 to be furnished with at least one leaf spring 1 which, employing the operating principle explained with regard to FIG. 1, ensures that the clamping surfaces lie precisely parallel on top of one another, and high clamping forces are achieved. Further embodiments of these self-aligning clamping surfaces are described hereinafter:

FIG. 3 shows a clamping and tensioning device which may, for example, be constructed like the one shown in FIG. 2. The invention of the instant application is not restricted, however, to such an embodiment, because clamping and tensioning devices of very many different types may be provided with the improvement according to the invention. In this clamping and tensioning device, both the first clamping bar 2 and the second clamping bar 3 are formed of three sections, 2', 2'', 2''' and 3', 3'', 3''', respectively, the individual sections of each pair of corresponding sections 2', 3''; 2'', 3''; and 2''', 3''' cooperating with one another.

The leaf springs 1 are formed with parts 13 projecting beyond the convex projecting or protruding part 7, the parts 13 being of such construction as to form a hollow 6 with respect to the first clamping bar 2, the hollow 6 providing space for a horizontal alignment. A result thereof is a reduction in the size of the convex and concave surfaces which have to slide on one another, thereby reducing the friction and facilitating the alignment. It is also possible, however, to furnish just the outer sections 2, 2'' with leaf springs 1 because, it is in these areas, as noted hereinbefore, that high clamping forces are particularly important. A further embodiment may call for the one section 2' to be furnished with two leaf springs 1, which will then be of a construction such as is shown in FIGS. 1, 7 and 8, respectively. Such a construction ensures the attainment of very high forces.

In the embodiment shown, the construction of the clamping surfaces 11 of the leaf springs 1 has been advantageously further developed in that the clamping surfaces 11 are in the form of concave clamping surfaces 5. In order to make this apparent, the horizontal surfaces have been indicated by dot-dash or phantom lines 4, and the concave form of the clamping surfaces 5 has been greatly exaggerated in FIG. 3 of the drawings. Due to this concave form of the clamping surfaces 5, the ends of the clamping surfaces 11 are nearer to the clamping surfaces 12 of the second clamping bar 3 than is the central region of the clamping surfaces 11 on the leaf springs 1. The leaf springs 1 must be of such elasticity that, when a printing plate is clamped, an elastic deformation of the leaf springs occurs, thereby ensuring that the clamping surfaces 11 and 12 lie flat on top of one another. Because the central region of the leaf springs is less elastic due to the mounting thereof on the clamping bar 2, a recess 14 is formed at this location. In this manner, despite foregoing a part of the clamping surface, it is possible to attain a higher clamping force, with the additional advantage that the components can be manufactured with larger tolerances and, therefore, considerably more economically.

FIG. 4 shows a leaf spring 1 with a mounting support thereof in the first clamping bar 2. The proportions are drawn approximately true to scale in this representation. The leaf spring 1 is provided in s central region thereof with a hole 10 which contains a spring pin 9 connected to the first clamping bar 2. The spring pin 9 has sufficient play or clearance 26 (note FIG. 5) in the hole 10 so that the horizontal alignment of the leaf spring 1 is not obstructed. The purpose thereof is to permit the spring pin 9 to hold the leaf spring 1 in the first clamping bar 2 so that it is unable to drop out.

Figure 5:
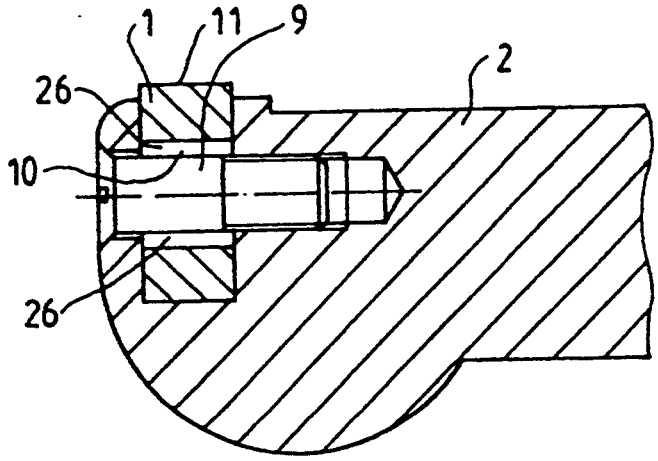

FIG. 5 is a sectional view of FIG. 4 taken in the region of the hole or bore 10 and the spring pin 9, with the play or clearance 26 being clearly visible.

FIG. 6 shows that the improvement according to the invention is integratable into other clamping devices. Shown as an example is the clamping of a printing-plate front edge, wherein the second clamping bar 3 is in the form of an upper fixed clamping bar having the clamping surface 12 which extends approximately tangentially with respect to the cylinder surface. The first clamping bar 2 is disposed in a recess formed in the cylinder and is movable in the radial direction, thereby permitting the first clamping bar 2 with the clamping surface 11 to be moved against the second clamping bar 3, thereby clamping the printing plate 25 therebetween. Disposed on the first clamping bar 2 is the leaf spring 1, which carries the clamping surface 11 and is of the construction described hereinbefore. Required for the displacement of the first clamping bar 2 is a non-illustrated clamping element which may, for example, be in the form of at least two springs. A likewise non-illustrated adjusting element must then ensure the opening of the clamping device while overcoming the force of the clamping springs.

Reference is made to published German Patent Document DE 41 29 831 A1 with regard to the construction details of such a clamping device.

FIG. 7 shows an embodiment for particularly high forces. This involves a respective section 2, 2''2''' of a first clamping bar, it being possible for the sections to be arranged as in FIG. 3. The leaf springs are of a construction similar to those shown in FIG. 1. The recess 14 serves to align the leaf springs in a manner similar to a balance scale. With such sections, both of the two leaf springs of the section and also the sections themselves are self-aligning due to the play or clearance of their mounting supports by means of the journals 27 in the cylinder 16. FIG. 8 shows the construction of such a leaf spring 1. This leaf spring, too, is formed with a hole or bore 10, so that it can be held in the clamping bar 2 in a manner which prevents loss thereof.

A multiplicity of clamping devices or clamping and tensioning devices have become known heretofore in the state of the art, which also can be susceptible of improvement in a manner according to the invention. The invention, therefore, is not restricted to the embodiments illustrated an described herein.

I claim:

1. Clamping device for locking a printing plate on a cylinder of a printing press, the clamping device comprising two parallel clamping bars formed with respective clamping surfaces, at least one of said clamping bars being movable perpendicularly to said clamping surfaces, and an element for producing a clamping force between said clamping bars, a first one of said clamping bars comprising at least one leaf spring formed with said clamping surface of said first clamping bar, said clamping surface thereof being cooperatively clampable with said clamping surface of the second one of said clamping bars, said first clamping bar further comprising means formed with at least one concave segment-shaped recess, said leaf spring being formed with a corresponding convex segment-shaped protrusion supported in said recess.

2. Clamping device according to claim 1, wherein said clamping bars, respectively, are formed of a plurality of sections, and including a plurality of leaf springs including said one leaf spring, at least one leaf spring of said plurality thereof being supported on each of said sections of said first clamping bar.

3. Clamping device according to claim 1, wherein said clamping bars, respectively, are formed of three sections, and including a plurality of leaf springs including said one leaf spring, at least one of said plurality of leaf springs being supported on respective outer ones of said sections of said first clamping bar.

4. Clamping device according to claim 2, wherein two leaf springs are supported on said sections.

5. Clamping device according to claim 1, wherein said leaf spring is formed with parts projecting beyond said convex protrusion thereof, said parts forming a hollow with respect to said first clamping bar, said hollow providing space for a horizontal alignment.

6. Clamping device according to claim 1, wherein said clamping surface formed on said leaf spring of said first clamping bar is a concave clamping surface having respective ends which are nearer to said clamping surface of said second clamping bar than is a central region of said concave clamping surface, said leaf spring having an elasticity which, in a clamped condition of said first and second clamping bars, permits said clamping surfaces to lie on top of one another.

7. Clamping device according to claim 6, wherein said central region of said concave clamping surface is formed with a recess.

8. Clamping apparatus according to claim 6, wherein a central region of said leaf spring is formed with a hole, and including a spring pin received with play in said hole formed in said leaf spring and being connected to said first clamping bar, said play providing a clearance of such dimension as to assure a horizontal alignment of said leaf spring.

* * * * *